United States Patent [19]

Modisette

[11] 4,378,681

[45] Apr. 5, 1983

[54] REFRIGERATION SYSTEM

[75] Inventor: Jerry Modisette, Houston, Tex.

[73] Assignee: Modisette, Inc., Houston, Tex.

[21] Appl. No.: 299,715

[22] Filed: Sep. 8, 1981

[51] Int. Cl.[3] ..... F25B 1/06

[52] U.S. Cl. ..... 62/500; 62/116; 62/5

[58] Field of Search ..... 62/500, 116, 238.3, 62/5

[56] References Cited

U.S. PATENT DOCUMENTS

| | | | |
|---|---|---|---|
| 2,097,104 | 10/1937 | Saha | 257/248 |
| 2,519,010 | 8/1950 | Zearfoss, Jr. | 62/500 |
| 2,586,002 | 2/1952 | Carson, Jr. et al. | 62/136 |
| 2,770,103 | 11/1956 | Florea | 62/96 |
| 2,786,341 | 3/1957 | Green | 62/138 |
| 2,790,310 | 4/1957 | Green | 62/136 |
| 2,839,901 | 6/1958 | Green | 62/138 |
| 3,049,891 | 8/1962 | Barkelew | 62/86 |
| 3,197,969 | 8/1965 | Over | 62/5 |
| 3,287,924 | 11/1966 | Bright | 62/5 |
| 3,500,897 | 3/1970 | Von Cube | 62/500 |
| 3,522,710 | 8/1970 | Merkulov | 62/5 |
| 3,550,390 | 12/1970 | Puzniak | 62/5 |
| 3,553,971 | 1/1971 | Crang | 65/2 |
| 3,982,378 | 9/1976 | Sohre | 60/650 |
| 4,170,116 | 10/1979 | Williams | 62/116 |
| 4,304,104 | 12/1981 | Grose | 62/500 |

*Primary Examiner*—Ronald C. Capossela

*Attorney, Agent, or Firm*—Pravel, Gambrell, Hewitt, Kirk & Kimball

[57] ABSTRACT

A closed refrigeration system in which a fluid refrigerated can be circulated includes a heater for converting the fluid to gas at a high pressure, an expansion chamber downstream of the heater, the expansion chamber including a cylindrical chamber with an inlet adapted for introducing the gas tangentially into the chamber, and an outlet coaxial with the chamber but of smaller diameter so that conservation of angular momentum increases the tangential velocity of the gas as it flows through the expansion chamber, producing an approximately isentropic expansion. A compression chamber is connected to the outlet of the expansion chamber, the compression chamber being approximately a mirror image of the expansion chamber so that the fluid undergoes approximately isentropic compression in passing through the compression chamber. A condenser condenses the fluid from the compression chamber to a liquid, which is circulated back to the heater. A portion of the liquid is diverted to a low pressure evaporator which provides refrigeration, with the evaporator outlet connected to an opening in the expansion chamber near the axis so that the low pressure causes the fluid to circulate through the evaporator. The fluid from the evaporator is entrained in the flow from the expansion chamber to the compression chamber, which is larger than the expansion chamber so as to accommodate the increased flow volume.

17 Claims, 5 Drawing Figures

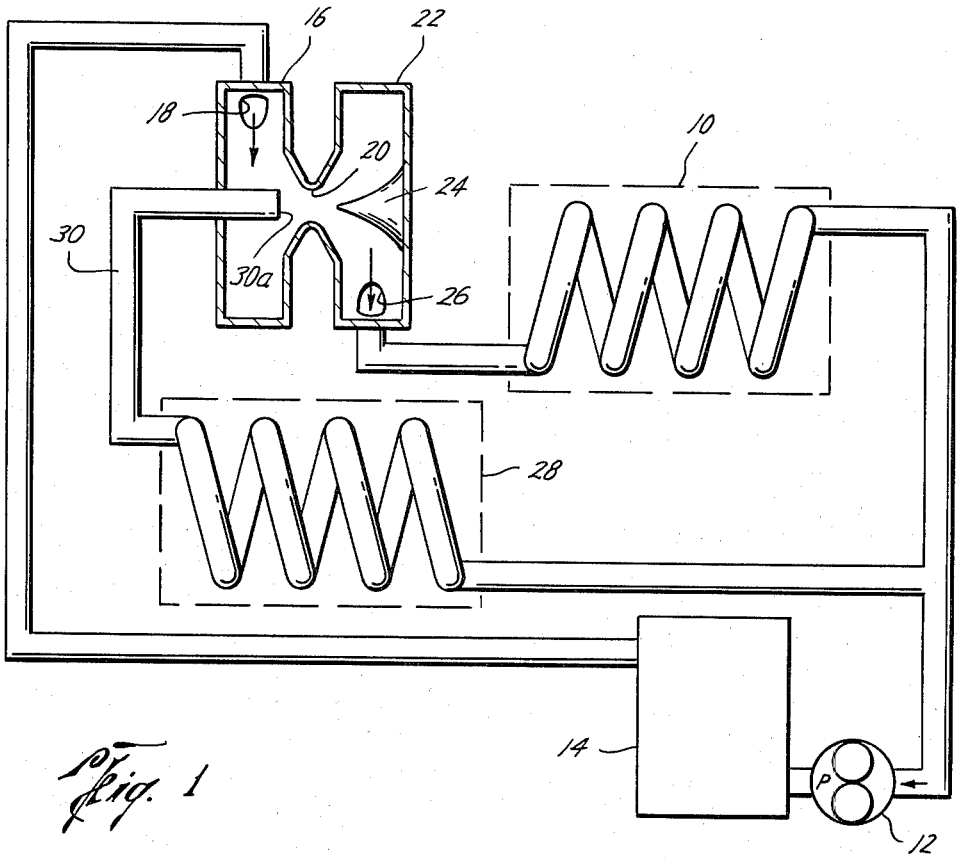
Fig. 1
Fig. 2
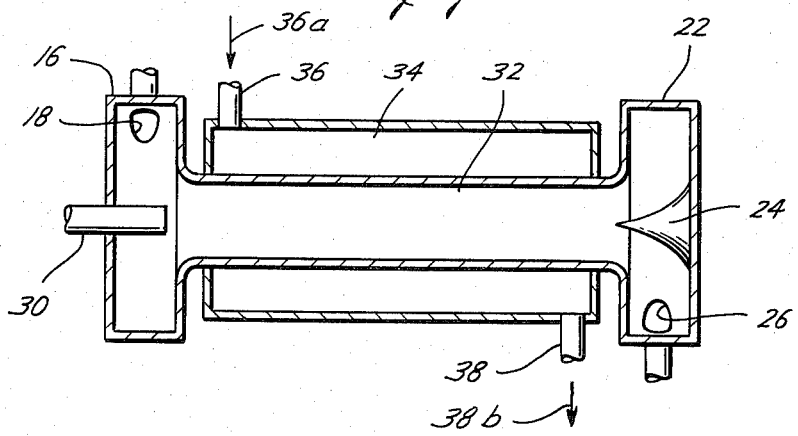

COMPRESSOR AS DRIVER

BOILER AS DRIVER

REFRIGERATION SYSTEM

BACKGROUND OF THE INVENTION

This invention relates to a refrigeration system which utilizes a swirling nozzle expansion chamber and, in particular, such a system that uses parallel driving and cooling circuits.

In conventional refrigeration systems a working fluid such as a fluorocarbon is cooled through an evaporator where the latent heat of vaporization is obtained from the sensible heat of the fluid, thereby reducing the temperature. In order for such evaporation to occur, the working fluid must be in the liquid state at a pressure below the vapor pressure of the fluid. In many conventional refrigeration cycles, the liquid state is obtained by compressing the fluid to a high pressure and temperature, rejecting the heat to the environment by conduction or convection, and then passing the fluid through a throttling valve to reduce the pressure in a isenthalpic expansion. The liquid then evaporates, absorbs heat, and is returned to the compressor to complete the cycle. This type of refrigeration system has the disadvantages that the compression requires power in the form of expensive mechanical energy, and that the throttling valve returns frictional work to the fluid in the form of heat.

Another type of conventional refrigeration system returns the evaporated working fluid to a liquid by absorbing it into a second liquid, for example, ammonia absorbed into water. The solution is then pumped to a high pressure, and the absorbed working fluid is boiled off by heating. The working fluid then passes through a throttling valve to an evaporator, as in the case of the compression-driven system above. This type of refrigeration system is primarily driven by heat, since the pump requires much less energy than the compressor. This type of system has the disadvantage that the solutions tend to be corrosive, and that the equilibrium is delicate and difficult to control.

An alternate way of expanding and compressing the fluid is through the use of a nozzle and a diffuser. The expansion and compression is approximately isentropic, so that the working fluid is cooled as it expands. This cooling can be used for refrigeration; however, it is difficult to transfer heat to the fluid, which is moving at supersonic velocities. The nozzle/diffuser arrangement can be used as a driver for the compression of a second stream of fluid which is entrained into the driver fluid between the nozzle and the diffuser. Such an arrangement is commonly called an ejector. The flow from the diffuser is a high temperature and pressure. The heat is transferred to the environment, and the fluid, consisting of both the working fluid and the driver fluid is condensed to a liquid. The high pressure liquid stream is divided again into the driver and working fluid streams, with the working fluid passing through a throttling valve to an evaporator, as in conventional systems, before returning to the ejector. Heat is applied to the driver fluid to boil it to a high pressure gas, which is expanded through the nozzle to complete the cycle.

The nozzle/diffuser system can be improved through the use of a configuration in which the major component of the fluid motion is tangential to the axis, thereby producing a swirling motion. The advantages are that the fluid remains in the nozzle longer so that heat transfer to the fluid is facilitated, that the diffuser is more stable, since it is constrained by the conservation of angular momentum, and that the size of a typical nozzle is increased so that fabrication is easier.

SUMMARY OF THE INVENTION

In accordance with the invention, a refrigeration system which utilizes a swirling nozzle for expanding the fluid is formed which includes a refrigeration loop that is driven by a parallel driver loop. The working fluid is circulated through both loops, dividing into two streams or rejoining where the two loops meet. The driver loop can be powered by a boiler, so that heat from various sources may be used for the energy to operate the refrigeration system. Refrigeration systems of this type can be adapted for use in a wide range of applications such as appliances, motor vehicles, residential and commercial buildings, using heat from various sources such as combustion, waste or exhaust heat or solar heat.

The driving loop includes a boiler in which the liquid working fluid is converted from a liquid to a gas at high pressure. The gas then flows into the expansion chamber where it undergoes isentropic expansion. The expansion chamber is in the form of a swirling nozzle with a cylindrical configuration and one or more input openings adapted for introducing the gas tangentially into the chamber. The gas flows at high velocity from the swirling nozzle expansion chamber through an outlet on the axis of the cylindrical chamber. As the gas leaves the expansion chamber it is at low pressure and temperature due to the expansion. The gas then flows to a swirling diffuser, also in the form of a cylindrical chamber, where it is compressed and the tangential velocity is reduced as the gas leaves the diffuser through tangential openings, which are larger than the openings serving as the inlets to the nozzle so as to provide for the increased gas volume. The gas from the diffuser flows into a heat rejector or condenser where it is cooled to the liquid state. The liquid is returned to the boiler through a feed pump, which makes up pressure losses incurred in the nozzle/diffuser part of the cycle, thus completing the driver loop.

The refrigeration loop includes an evaporator operating at low pressure which vaporizes a portion of the fluid, which is diverted from the driver loop at the outlet of the condenser. This evaporation produces most, or in some applications, all of the refrigeration. The outlet of the evaporator goes to a low pressure region of the swirling nozzle, where the gas from the refrigeration loop rejoins the driver gas. Some refrigeration, at a very low temperature, can be obtained by conduction or convection of heat from outside the system to the cold gas in the nozzle throat and in the conduit from the nozzle to the diffuser.

The entire system thus acts as an ejector type refrigeration system with the advantage that the swirling nozzle and diffuser provide a more stable operation. The production of most of the velocity of the fluid in the tangential component gives a longer residence time of the fluid in the nozzle/diffuser, thereby facilitating entrainment of the fluid from the refrigeration loop, transfer of heat to the cold fluid, and recompression of the gas in the diffuser. The major driving energy is the thermal energy supplied to the boiler, which may come from any source such as combustion, solar or waste heat.

BRIEF DESCRIPTION OF THE DRAWINGS

FIG. 1 is a schematic diagram of a refrigeration system designed in accordance with the invention, in which refrigeration is obtained in the evaporator;

FIG. 2 shows an alternate embodiment where a second refrigeration heat exchanger is provided between the swirling nozzle and diffuser;

DETAILED DESCRIPTION OF THE PREFERRED EMBODIMENTS

Figure 3:
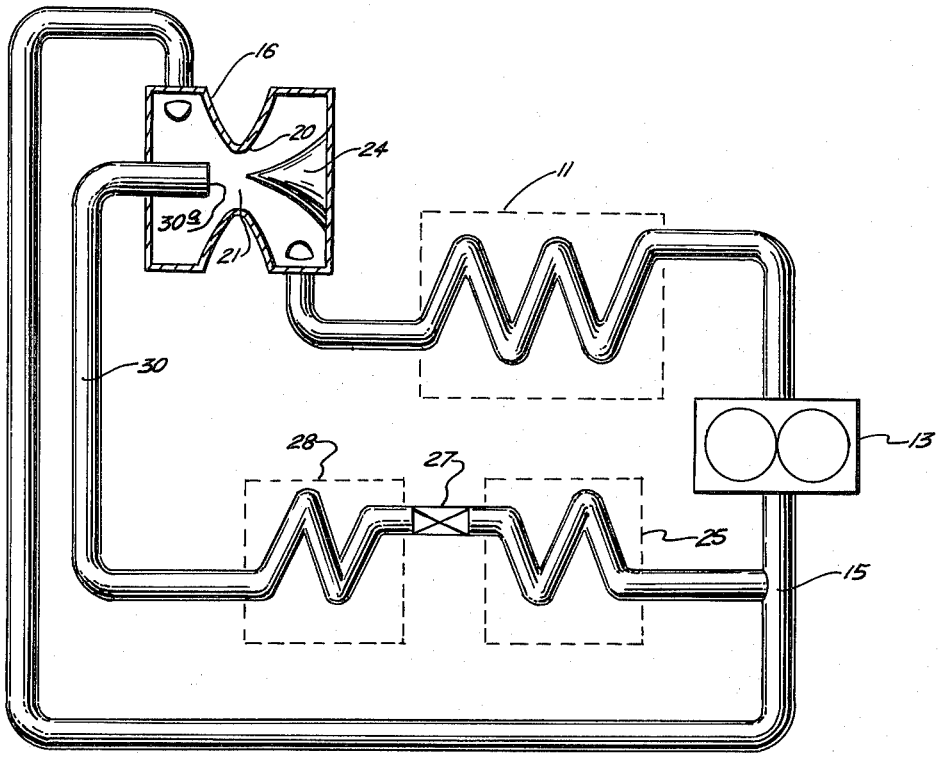
FIG. 3 shows an alternate embodiment where a compressor replaces the pump and boiler as the driving force of the system.

Referring to FIG. 1, reference numeral 14 designates a boiler or other suitable heating means for converting the liquid working fluid to a gas at a relatively high pressure. The boiler is heated by any conventional means such as combustion, or by solar or waste heat such as an automobile exhaust. High pressure gas flows from the boiler 14 to a swirling nozzle expansion chamber 16 through one or more tangential openings 18. The expansion chamber is cylindrical in shape, about an axis 21. The size of the tangential openings is determined from the desired flow rate through the system to give a tangential velocity such that most of the velocity of flow in the nozzle is in the tangential component. The gas is accelerated to much higher velocity as it approaches the constricted outlet 20 of the nozzle. Conservation of angular momentum requires the tangential component of the velocity to increase in inverse proportion to the distance of the gas from the axis 21 of the nozzle. The expansion process is approximate isentropic so that the pressure and temperature are greatly reduced at the nozzle outlet 20. The swirling nozzle expansion chamber is connected through the restricted outlet 20 to a swirling diffuser 22 which is essentially an inverted image of the nozzle 16. Minor dimensional changes are preferably made to the diffuser 22 relative to the dimensions of the nozzle 16 to accommodate the effects of entrainment of the refrigerant fluid, the addition of heat to the gas, and boundary layer growth. A fluid guide 24 in the shape of a generally conical surface smoothly directs the fluid to one or more tangential outlets 26 which allows for the conservation of angular momentum to reduce the angular velocity and for an approximately isentropic recompression of the gas.

The working fluid which has been heated by compression in the diffuser 22 passes then to the heat rejector or condenser 10 in the form of an air cooler, spray tower, or other device known in the art. In the condenser the working fluid is condensed into a liquid. A pump 12 is used to move the liquid from the condenser 10 to the boiler 14, and to increase the pressure in compensation for any losses in the cycle.

The series of components just described make up what will be called the driving loop of the refrigeration system which is the subject of the instant invention. The driving action, as mentioned above, is provided primarily by the heat supplied by the boiler 14 assisted by the pump 12.

A second loop, which can be called the refrigeration loop, includes an evaporator 28 to which a portion of the liquid from the condenser is diverted through a conventional expansion valve 27. The evaporator produces refrigeration by vaporizing the liquid at a relatively low pressure so that it absorbs latent heat of refrigeration and provides the cooling effect for the refrigeration system. The output of the evaporator 28 flows through a conduit 30, the downstream end of which **30*a* is located in a low pressure region near the center of the swirling nozzle so that the swirling nozzle expansion chamber 16 will in effect act as a vacuum pump causing fluid to circulate through the refrigeration loop. The gas from the refrigeration loop is entrained in the driver loop gas in the swirling nozzle/diffuser, so that the total cross-sectional area of the one or more tangential outlets 26 of the diffuser 22 should be large enough to accommodate the total volume of flow, including any expansion due to heating in the swirling nozzle 16, restricted outlet 20, and diffuser 22**. The relative flow proportions through the driving and refrigeration loops are balanced by appropriate ports, valves, or other means known to the art for controlling flow, the design of which can be accomplished by one with ordinary skill in the art.

The pump 12, as mentioned above, is located in a position in the system so that it pumps the working fluid when it is a liquid form. This reduces the flow rate through the pump which reduces the mechanical energy requirement of the system. Alternative to the location of the pump shown in FIG. 1, the pump can be located downstream from the condenser 10 but upstream of the refrigeration loop diversion 15 so that fluid at a higher pressure is circulated through the expansion valve 27 to the evaporator 28. This latter location of the pump 12 is used to give a wider range of control of the temperature in the evaporator.

In an alternative embodiment of the invention shown in FIG. 2, the swirling nozzle 16 and diffuser 22 are connected through an axial chamber 32 which is elongated so that the working fluid remains in the low temperature state for a longer time. This permits an effective transfer of heat to be made to the working fluid, which has been cooled by expansion in the swirling nozzle 16. The heat exchanger can function by conduction through the wall of the chamber 32 from a jacket 34 through which water, air or other fluid is circulated as shown by inlet 36 and outlet 38 and arrows **36*a* and 38*a*. Other conduction means such as fins (not shown) connected to the outer surface of the chamber 32 or a pipe extending through the interior of chamber 32**, concentric with the axis, could be used. This alternative embodiment could be used to provide a relatively lower temperature refrigeration unit while the evaporator provides a relatively higher temperature. Both embodiments can be used in the same unit to provide two levels of refrigeration.

In an alternate embodiment of the invention shown in FIG. 3, a compressor 13 replaces the function of the pump 12 and boiler 14 in FIG. 1. The condenser 10 in FIG. 1 is replaced by a much smaller condenser 25 in the refrigeration loop in FIG. 3. In order to aid in rejecting heat from the system, a cooling heat exchanger 11 is added before the compressor. This cooler may also be placed after the compressor, for more efficient heat transfer, but at the cost of increasing the requirement for compressor capacity. In operation of this alternate embodiment, the compressor 13 supplies the high pressure gas to drive the system. Refrigeration is obtained at the evaporator 28 and/or at the nozzle outlet (which may be elongated as in the alternative embodiment shown in FIG. 2) in the same manner as in the alternative embodiments shown in FIGS. 1 and 2.

Extremely low temperature refrigeration may be obtained with this alternate embodiment by eliminating the refrigeration loop, elongating the connection 32 between the nozzle and diffuser as shown in FIG. 2, and using a gas with a low condensation temperature, such as nitrogen or helium, as the working fluid.

This alternative embodiment is driven by mechanical energy supplied to the compressor, in a similar manner to many conventional systems. However, it has the advantage of requiring a lower pressure increase across the compressor, since the diffuser 22 acts to increase the pressure of the working fluid from the level in the evaporator 28. This advantage can eliminate the requirement for two-stage compression in the case of low temperature refrigeration.

Figure 4:
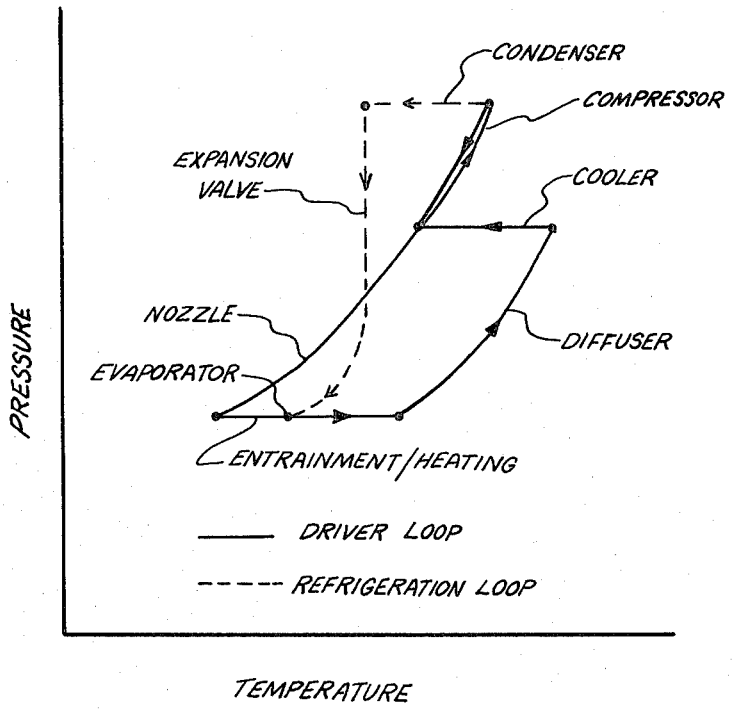
FIGS. 4 and 5 show the respective thermodynamic cycles of the driver and refrigeration loops.
Figure 5:
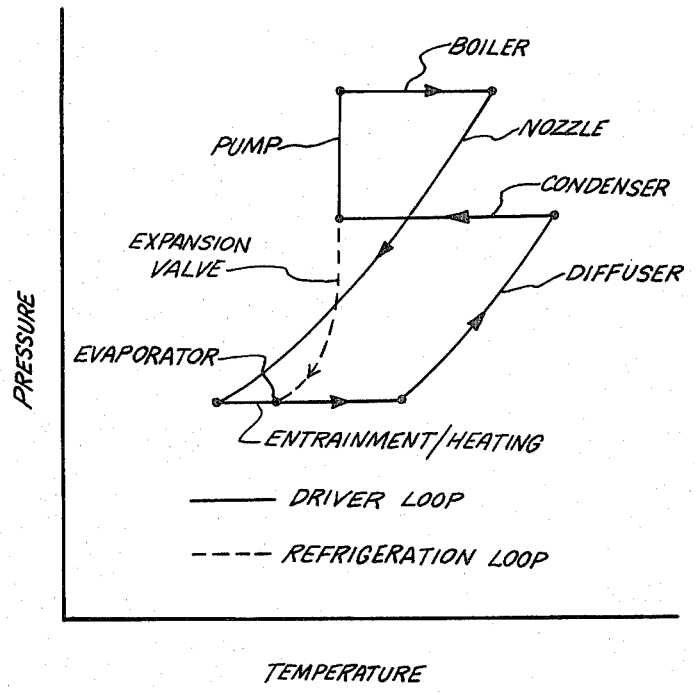

FIG. 4 shows the thermodynamic cycles of the driver and refrigeration loops for the various alternative embodiments.

In the refrigeration system described in detail above, the various alternative embodiments provide for flexibility so that efficient use of energy, simplicity of operation and maintenance, and a wide range of operating conditions can be obtained.

The foregoing disclosure and description of the invention are illustrative and explanatory thereof, and various changes in the size, shape, and materials as well as the details of the illustrated construction may be made without departing from the spirit of the invention and all such changes are contemplated as falling within the scope of the appended claims.

I claim:

1. A closed refrigeration system in which a fluid refrigerant can be circulated, comprising:

(a) heating means for converting the fluid to a relatively high pressure gas;

(b) an expansion chamber downstream from the heating means, the expansion chamber including a cylindrical chamber with a fluid inlet opening adapted for introducing the gas tangentially into the chamber and an outlet concentric about the chamber axis, and of smaller diameter than the chamber so that conservation of angular momentum causes the fluid to increase the tangential component of its velocity, thereby producing an approximately isentropic expansion with reduced pressure and temperature as it passes through the expansion chamber;

(c) a compression chamber connected to the outlet of the expansion chamber, the compression chamber being approximately a mirror image of the expansion chamber, so that the tangential component of the fluid velocity is caused to decrease by the conservation of angular momentum as the fluid passes from the small diameter inlet to the tangential outlet, thereby producing an approximately isentropic compression;

(d) condensing means downstream of the compression chamber and upstream of the heating means for condensing the gas from the compression chamber to a liquid;

(e) vaporizing means for vaporizing a portion of the liquid at a relatively low pressure for providing refrigeration, the inlet of the vaporizing means being connected between the condensing means and the heating means for diverting a portion of the fluid flowing from the condensing means;

(f) a conduit connected at one end to the outlet of the vaporizing means, the other end being located on the axis of the expansion chamber so that the low pressure region will cause fluid to circulate through the vaporizing means;

(g) circulating means for circulating fluid through the condensing means, heating means, expansion chamber, and compression chamber;

(h) the outlet of the compression chamber being larger than the inlet to the expansion chamber so as to accommodate the increased flow volume, including the added flow from the evaporator and the increased volume of the gas due to heating;

(i) means within the expansion chamber in the form of a generally conically shaped body to guide the flow to the tangential outlet in a smooth manner.

2. The system of claim 1, wherein the circulating means includes a pump located downstream from the condensing means and upstream from the heating means.

3. The system of claim 2, wherein the pump is located downstream from where a portion of the fluid is diverted to the vaporizor.

4. The system of claim 1, wherein the inlet to the expansion chamber includes a plurality of tangential openings.

5. The system of claim 1, wherein the outlet of the compression chamber includes a plurality of outlet openings.

6. The system of claim 1, wherein a refrigeration heat exchanger is provided in the form of a tubular conduit through which the fluid circulates located between the expansion chamber and the compression chamber.

7. The system of claim 6, wherein a second level of refrigeration is provided by a refrigeration heat exchanger in the form of a jacket around the tubular conduit between the expansion chamber and output chamber with means for circulating material to be refrigerated through the jacket.

8. A closed refrigeration system in which a fluid refrigerant can be circulated, comprising:

(a) means for compressing the fluid to a high pressure;

(b) an expansion chamber downstream from the compressor, the expansion chamber including a cylindrical chamber with a fluid inlet opening adapted for introducing the gas tangentially into the chamber and an outlet concentric about the chamber axis, and of smaller diameter than the chamber so that conservation of angular momentum causes the fluid to increase the tangential component of its velocity, thereby producing an approximately isentropic expansion with reduced temperature and pressure as it passes through the expansion chamber;

(c) a compression chamber connected to the outlet of the expansion chamber, the compression chamber being approximately a mirror image of the expansion chamber, so that the tangential component of the fluid velocity is caused to decrease by the conservation of angular momentum as the fluid passes from the small diameter inlet to the tangential outlet, thereby producing an approximately isentropic compression;

(d) a conduit connecting the outlet of the compression chamber to the inlet of the compression means;

(e) condensing means for condensing a portion of the fluid to a liquid, the inlet of the condensing means being connected between the outlet of the compression chamber and the inlet of the means for compressing the fluid in order to divert a portion of the fluid flowing from the compression chamber;

(f) vaporizing means for vaporizing the liquid from the condensing means at a relatively low pressure for providing refrigeration, the inlet of the vaporizing means being connected to the outlet of the condensing means;

(g) a conduit connected at one end to the outlet of the vaporizing means, the other end being located on the axis of the expansion chamber so that the low pressure region will cause fluid to circulate through the vaporizing means;

(h) the outlet of the compression chamber being larger than the inlet to the expansion chamber so as to accommodate the increased flow volume, including the added flow from the evaporator and the increased volume of the gas due to heating;

(i) means within the expansion chamber in the form of a generally conically shaped body to guide the flow to the tangential outlet in a smooth manner.

9. The system of claim 8, wherein the means for compressing the fluid is a mechanical compressor.

10. The system of claim 8, wherein the inlet of the condensing means is connected between the means for compressing the fluid and the expansion chamber.

11. The system of claim 8, wherein the inlet to the expansion chamber includes a plurality of tangential openings.

12. The system of claim 8, wherein the outlet to the compression chamber includes a plurality of tangential openings.

13. The system of claim 8, wherein cooling means for removing heat from the gas is provided between the expansion chamber and the compression means.

14. The system of claim 8, wherein cooling means for removing heat from the gas is provided between the means for compressing the fluid and the expansion chamber.

15. The system of claim 8, wherein a refrigeration heat exchanger is provided in the form of a tubular conduit through which the fluid circulates, located between the expansion chamber and the compression chamber.

16. The system of claim 15, wherein a second level of refrigeration is provided by a refrigeration heat exchanger in the form of a jacket around the tubular conduit with means to circulate material to be refrigerated through the jacket.

17. The system of claim 15, wherein the fluid is a gas with a low condensing temperature, and the condensing means and the evaporating means are eliminated, so that refrigeration to very low temperatures is obtained in the tubular conduit between the expansion chamber and the compression chamber.

* * * * *